US006655270B2

(12) United States Patent
Schaede

(10) Patent No.: US 6,655,270 B2
(45) Date of Patent: Dec. 2, 2003

(54) PRINTING UNIT HAVING SCREEN PRINTING CYLINDERS AND TRANSFER CYLINDERS FORMING PRINTING NIP

(75) Inventor: Johannes Georg Schaede, Würzburg (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/181,427

(22) PCT Filed: Dec. 16, 2000

(86) PCT No.: PCT/DE00/04501

§ 371 (c)(1),
(2), (4) Date: Jul. 25, 2002

(87) PCT Pub. No.: WO01/54905

PCT Pub. Date: Aug. 2, 2001

(65) Prior Publication Data

US 2003/0010230 A1 Jan. 16, 2003

(30) Foreign Application Priority Data

Jan. 25, 2000 (DE) ..... 100 03 027
May 25, 2000 (DE) ..... 100 25 999

(51) Int. Cl.[7] ..... B41F 15/08; B41F 15/22; B41L 13/04

(52) U.S. Cl. ..... 101/116; 101/114; 101/118; 101/120

(58) Field of Search ..... 101/116, 117, 101/119, 129, 229, 231, 232, 217, 246, 183, 219, 220, 221, 115, 114, 492, 120

(56) References Cited

U.S. PATENT DOCUMENTS

| | | | | |
|---|---|---|---|---|
| 2,132,086 A | * | 10/1938 | Scheffler | 101/175 |
| 3,915,087 A | * | 10/1975 | Tiemann | 101/115 |
| 4,103,615 A | | 8/1978 | Cruz et al. | 101/120 |
| 5,285,724 A | | 2/1994 | Kobayasi et al. | 101/120 |
| 5,373,785 A | * | 12/1994 | Yamamoto et al. | 101/116 |

FOREIGN PATENT DOCUMENTS

| | | |
|---|---|---|
| DE | 2 202 545 | 8/1973 |
| DE | 26 38 344 | 7/1977 |
| DE | 42 30 448 A1 | 3/1993 |
| EP | 0 723 864 B1 | 8/1998 |
| EP | 0 864 421 A1 | 9/1998 |
| EP | 0 949 069 A1 | 10/1999 |
| JP | 11 129599 | 5/1999 |

* cited by examiner

*Primary Examiner*—Leslie J. Evanisko
(74) *Attorney, Agent, or Firm*—Jones, Tullar & Cooper, P.C.

(57) ABSTRACT

A printing unit includes two screen-printing cylinders and two transfer cylinders that cooperate with the screen-printing cylinders and which define a printing gap or nip. At least one of the screen-printing cylinders has a screen surface and an interior doctor blade. A support element is provided for handling radially outwardly directed pressure exerted by the doctor blade on the screen surface in one section of the screen surface.

5 Claims, 4 Drawing Sheets

PRINTING UNIT HAVING SCREEN PRINTING CYLINDERS AND TRANSFER CYLINDERS FORMING PRINTING NIP

FIELD OF THE INVENTION

The present invention is directed to a printing unit with first and second screen-printing cylinders. Transfer cylinders cooperate with the screen-printing cylinders.

BACKGROUND OF THE INVENTION

EP 07 23 864 B1 discloses a printing unit for a rotary printing press. This printing unit has a first screen-printing cylinder and a printing nip formed by two cylinders, in which a print stock is printed.

A screen-printing cylinder of this prior printing unit forms a printing nip in cooperation with a counter-pressure cylinder, which has circumferential sections, each with a reduced radius in which sheet grippers are disposed. On the interior of the screen-printing cylinder, a doctor blade device is provided, and is oriented toward the printing nip. This doctor blade device presses against the screen of the screen-printing cylinder and pushes ink through it. In order to prevent the screen from being deformed, when a circumference section with a reduced radius passes through the printing nip, a mechanism is provided which pulls the doctor blade device back from the screen at these times.

This prior art printing unit is only suitable for one-sided printing. The mechanism for retracting the doctor blade device is complex.

JP 11-129599 A discloses a screen-printing press with two screen-printing cylinders and a sheet-feeding transfer cylinder.

EP 0 949 069 A1 describes an offset printing press with cooperating transfer cylinders, which can be preceded by a screen-printing unit.

SUMMARY OF THE INVENTION

The object of the present invention is to provide a printing unit.

The object of the present invention is attained according to the invention by the provision of a printing unit with first and second screen-printing cylinders. Each screen-printing cylinder is associated with its own transfer cylinder. The two transfer cylinders cooperate to form a printing nip.

The advantages that can be achieved with the present invention are comprised particularly in the fact that it permits first forme printing and second forme printing, in the screen-printing process, with matching registers to be executed in a single printing procedure. The screen-printing cylinder is distinguished in particular by its uncomplicated construction.

In the printing unit in accordance with the present invention, at least one of the two screen-printing cylinders prints a first side of the print stock indirectly by use of a transfer cylinder. This transfer cylinder is the second of the two cylinders that form the printing nip and can therefore simultaneously serve as a counter-pressure cylinder for printing the second side of the print stock.

Preferably, the first of the two cylinders that form the printing nip is also a transfer cylinder. This results in an essentially symmetrical configuration of the printing unit of the present invention, with the same printing properties on both sides of the print stock.

In order to also permit an exact, register-matching printing, in relation to the edge of a sheet-like print stock, preferably at least one of the two cylinders that form the printing nip is equipped with a holding mechanism for the sheet-like print stock.

To be able to apply ink to the screen-printing cylinders, these screen-printing cylinders are each suitably provided with a doctor blade device on its interior, which doctor blade device is for use in pressing ink through a screen mounted on the screen cylinder. A device for preventing the doctor blade device from deforming the screen that it presses against is also advantageously provided in a specific circumferential section of the screen. This device prevents the screen from being excessively deformed when it is pressed against the holding mechanism or when it is pressed into a channel, which is complementary to the holding mechanism and which is disposed on the respective other cylinder forming the printing nip. This device thus prevents the screen from wearing too rapidly or from being damaged.

A device of this kind can be or can include an adjusting mechanism, which retracts the doctor blade device radially inward when the specific circumferential section of the screen-printing cylinder passes in front of the doctor blade device. In accordance with a second feature of the present invention, the screen deformation preventing device is a support element, which extends axially on the screen-printing cylinder in the vicinity of the specific circumferential section and serves to absorb a pressure exerted by the doctor blade in a radially outward direction on the specific circumferential section.

In order to prevent synchronization errors of the screen-printing cylinder, when the doctor blade device comes into contact with the support element and/or leaves contact with it, the support element is preferably provided with leading and trailing edges for the doctor blade device. These leading and trailing edges extend at an angle to a generatrix of the circumferential surface of the screen cylinder. Since the doctor blade device necessarily extends parallel to such a generatrix, the doctor blade device does not come into contact or leave contact with the support element over its entire span at one time, but only at certain points. In addition, braking forces acting on the screen-printing cylinder therefore remain low and are distributed over a finite section of the circumference of the screen-printing cylinder.

BRIEF DESCRIPTION OF THE DRAWINGS

Preferred embodiments of the present invention are shown in the drawings and will be described in detail below.

DESCRIPTION OF THE PREFERRED EMBODIMENTS

Figure 1:
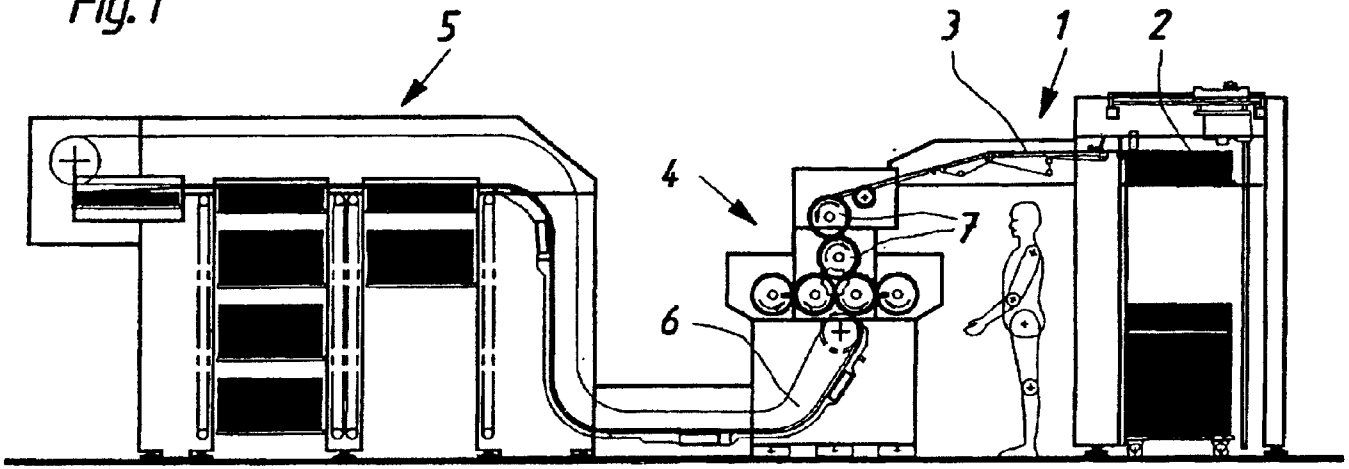
FIG. 1 is a schematic side elevation view of a printing press with a printing unit in accordance with the present invention.

Referring initially to FIG. 1, there may be seen a schematic view of, for example a sheet-fed rotary printing press in which a printing unit 4, in accordance with the present invention, is used. The printing press has a sheet feeder 1 with a sheet stacker 2, from whose top, which is automatically kept at a constant height, sheets to be printed are fed individually, or in a continuous stream, by a belt conveyor 3 to the printing unit 4, which takes the sheets one at a time, prints them, and outputs them to a chain conveyor 6, which, in the case of multicolor printing, feeds them to other printing units like the printing unit 4 or, as shown in FIG. 1, feeds them directly to an output stack 5.

The sheets pass through the printing unit 4 from top to bottom. A larger scale depiction of the printing unit 4 is provided in FIG. 2 .

Figure 2:
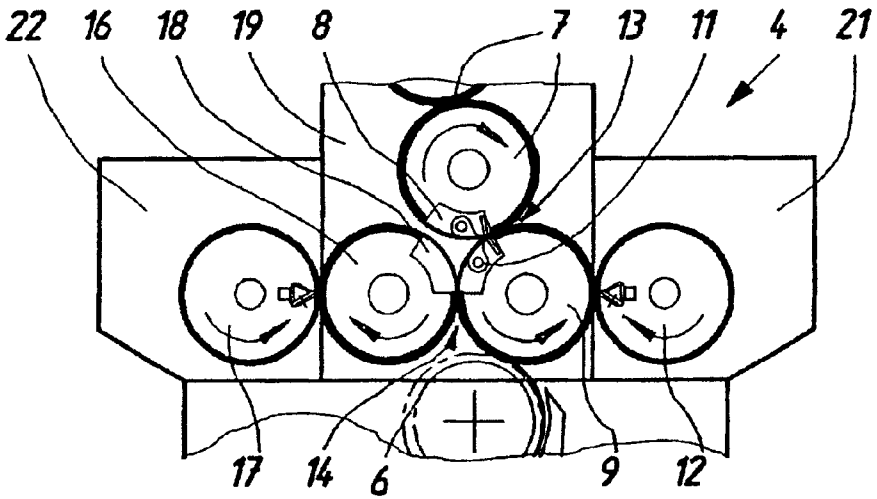
FIG. 2 is a schematic side elevation view of the printing unit of the machine depicted in FIG. 1.

Two transport cylinders 7, the upper one of which is shown only partially in FIG. 2, are each provided with sheet grippers in a respective section 8 of their circumferences in order to take the edges of sheets, which are to be printed, from the first belt conveyor 3 in a register-matching manner. The lower one of the two transport cylinders 7 rolls in contact with a first transfer cylinder 9. The first transfer cylinder 9 is embodied, for example, as a first rubber blanket cylinder 9 and is likewise equipped with a sheet gripper in a section 11 of its circumference for use in receiving the sheets from the lower transport cylinder 7. The first transfer cylinder or rubber blanket cylinder 9 also rolls in contact with a first screen-printing cylinder 12, so that a printing pattern is transferred from the first screen-printing cylinder 12 to it, which printed pattern is printed on a sheet conveyed in a first nip 13 between the lower transport cylinder 7 and the first rubber blanket cylinder 9. The structure of the first screen-printing cylinder 12 will be discussed in more detail below.

After passing through the first nip 13, a sheet to be printed reaches a second nip 14 between the first rubber blanket cylinder 9 and a second transfer cylinder 16, which is also embodied as a rubber blanket cylinder 16. In this second nip 14, the sheet is printed on its second side with a pattern that has been transferred to the second transfer or rubber blanket cylinder 16 from a second screen-printing cylinder 17.

The second rubber blanket cylinder 16 does not have a sheet gripper assembly. Instead, a section 18 of its circumference is provided with a channel, which permits the sheet gripper assembly 11 of the first rubber blanket cylinder 9 to pass through the nip 14.

Since the first and second transfer or rubber blanket cylinders 9 and 16 and with them, the first and second screen-printing cylinders 12 and 17 as well, can rotate in a coupled fashion, it is easy to achieve an exact and durable register matching of the printing on the front and back sides of the sheets by executing a manual or automatic fine adjustment of the printing formes mounted on the first and second screen-printing cylinders 12 and 17 in relation to each other in the axial direction and in the circumference direction of the cylinders 9; 16; 12; 17.

The various cylinders 7; 9; 16; 12; 17 discussed above are each supported at their ends in lateral side frames or mounts 19; 21; 22, a seen in FIG. 2. In the printing unit shown in FIG. 2, these lateral side frames or mounts 19; 21; 22 are comprised of a central module, which supports the transport cylinders 7 and the two rubber blanket cylinders 9; 16, as well as two lateral modules, which each support one of the screen-printing cylinders 12; 17. The end plates of each module are connected to each other so that they form a rigid frame unit, which can be removed from the printing unit 4 along with the screen-printing cylinder 12 or 17 that it supports. A module of this kind can be replaced, for example, by another module, which contains a forme cylinder, e.g. for conventional flat offset printing or the like. This permits the printing units, such as printing unit 4 to be easily adapted to a variety of requirements in order to print documents, in which different printing techniques are used for the front and back sides, with matching registers in a single pass.

Figure 3:
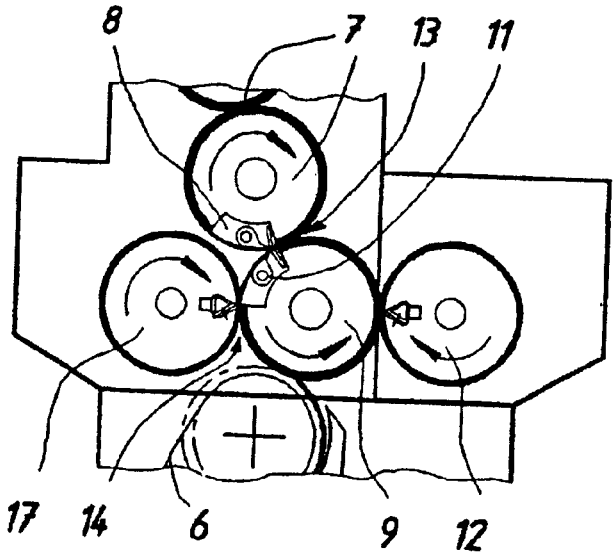
FIG. 3 is a schematic side elevation view of a printing unit in accordance with a second preferred embodiment of the present invention.

FIG. 3 depicts a simplified configuration of the printing unit shown in FIG. 2. In this simplified configuration, elements that correspond to those of the printing unit from FIG. 2 are provided with the same reference numerals. In the configuration of the printing unit of FIG. 3, the second rubber blanket cylinder 16 is omitted and instead, the second screen-printing cylinder 17 forms the second printing nip 14 directly with the first rubber blanket cylinder 9. The first rubber blanket cylinder 9 consequently performs the function of a counter-pressure cylinder for the second screen-printing cylinder 17.

Examples of suitable configurations of the screen-printing cylinder or cylinders 12 and 17, for use in the printing unit of the present invention will be described below in conjunction with FIGS. 4*a*, 4*b*, and 5.

Figure 4A:
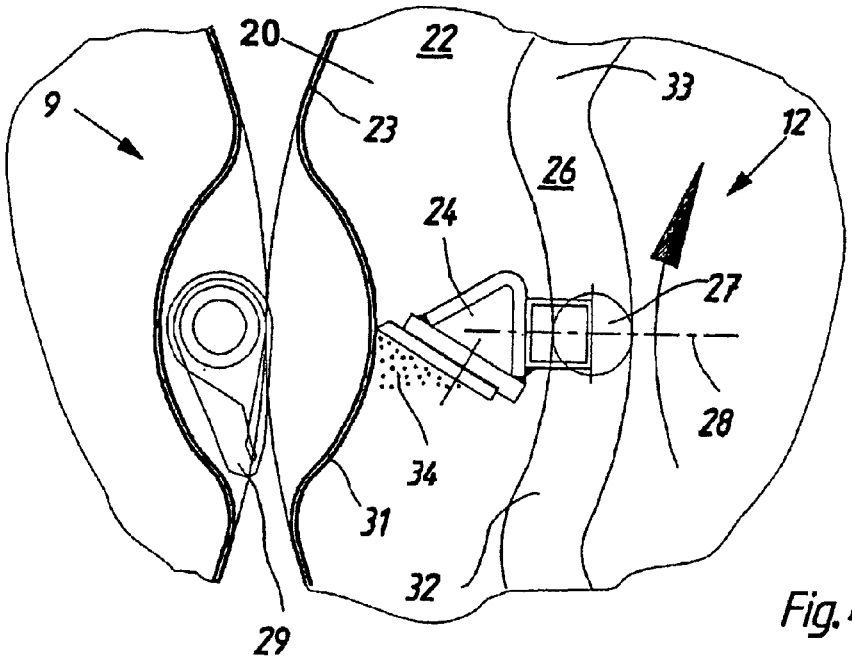
FIGS. 4*a* and 4*b* each show a detail of a screen-printing cylinder and a transfer cylinder cooperating with it, in two phases of the rotational movement of the cylinders.
Figure 4B:
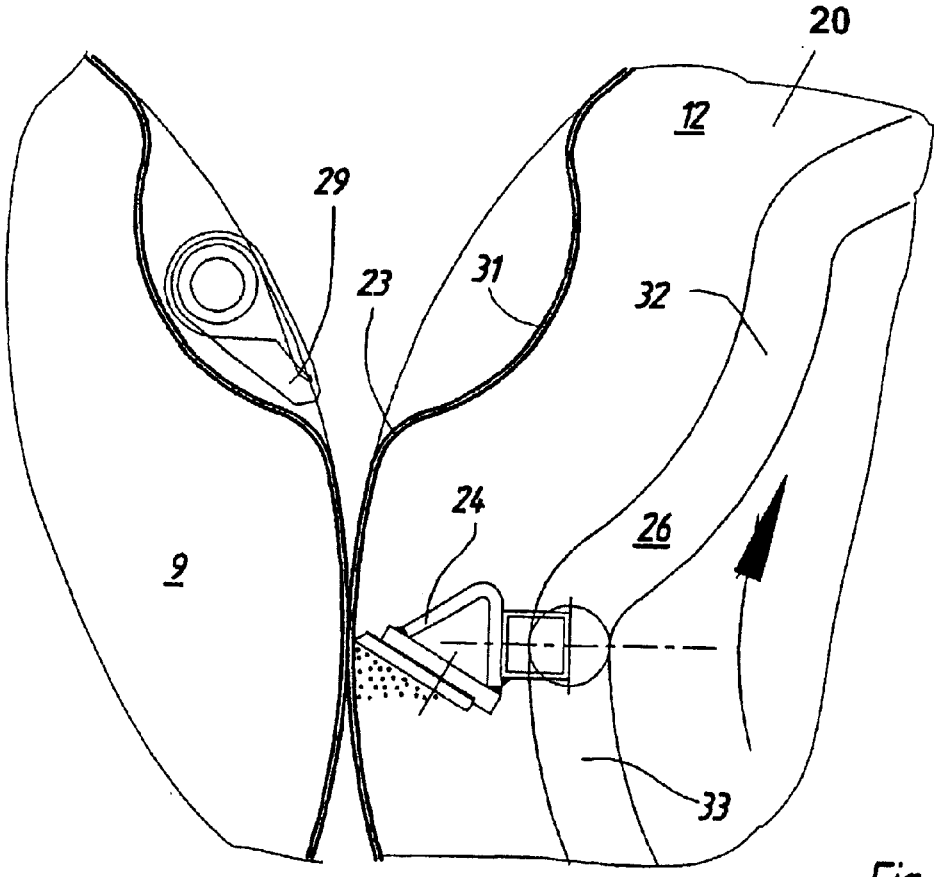

FIGS. 4*a* and 4*b* each show a partial section of the first screen-printing cylinder 12 in the vicinity of the first nip 13, which it forms with the first rubber blanket cylinder 9. The structures described here, however, can also be used in the same way for the configuration of the second screen-printing cylinder 17.

The first screen-printing cylinder 12 has a support ring 20 at each of its axial ends, whose outer circumference has a screen 23 stretched onto it. Screen 23 may be made of silk or polyamide gauze or bronze wire mesh. On the interior of the screen-printing cylinder 12, a doctor blade 24 is provided, whose position in the radial direction is controlled by a curved body, in this instance a curved guide slot 26 located at the ends of the screen-printing cylinder 12, and through which a cylindrical guide projection 27 of the doctor blade 24 extends. Outside of the screen-printing cylinder 12, the guide projection 27 is supported at both ends so that it can move in the direction of a line 28 connecting the rotation axes of the two cylinders 9 and 12. FIG. 4*a* shows the doctor blade 24 in a position in which the sheet gripper mechanism 29 of the first rubber blanket cylinder 9 is passing through the first nip 13 between the two cylinders 9 and 12. Opposite from the sheet gripper mechanism 29, the screen 23 has a screen section 31 that is indented radially inward. The guide slot 26 has an arc-shaped guide slot section 33, not shown completely in FIG. 4*a*, which is concentric to the cylindrical outer surface of the screen 23, and an inwardly indented guide slot section 32, whose curvature corresponds to that of the screen section 31. The curvature of the guide slot section 32 is selected so that when the guide slot section 32 moves past the cylindrical doctor blade guide projection 27 during the rotation of the first screen-printing cylinder 12, the doctor blade 24 is retracted radially inward so far that it exerts only a minimal pressure against the screen 23, which produces no appreciable deformation of the screen 23 in the screen section 31, or is retracted so far that it loses all contact with the screen 23 and consequently exerts no pressure on screen section 31, which could deform this screen section and could damage it during the course of operation.

FIG. 4*b* shows the position of the doctor blade 24 after the guide slot section 32 has passed the guide projection 27. The arc-shaped section 33 of the guide slot 26 keeps the doctor blade 24 pressed against the inside of the screen 23 so that ink 34 disposed against the doctor blade 24 is pressed through the open regions of the screen 23 and is thus transferred to the first rubber blanket cylinder 9.

Figure 5:
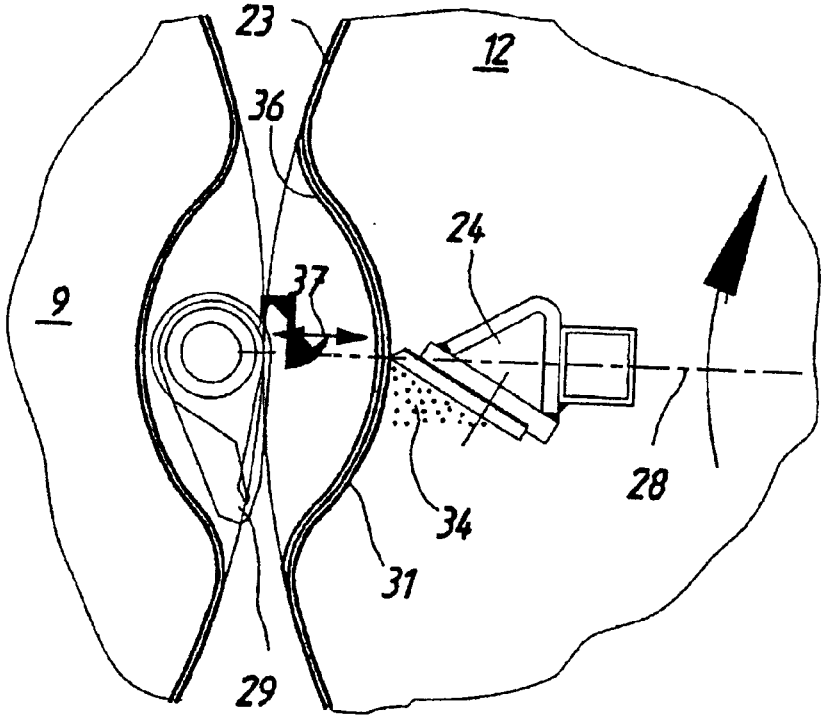
FIG. 5 is a side elevation view of a modification of the screen-printing cylinder depicted in FIG. 4*a*.

FIG. 5 shows a modification of the first screen-printing cylinder 12 depicted in FIGS. 4*a* and 4*b*. Elements that correspond to those of the first screen-printing cylinder 12 described above are provided with the same reference numerals and will not be described again. The structure of the screen-printing cylinder 12 depicted in FIG. 5 is simplified through the elimination of the guide slot 26. A spring device, which is not specifically shown in FIG. 5, keeps the doctor blade 24 pressed against the screen 23. The doctor blade 24 consequently remains in contact with the screen 23 even when the indented screen section 31 passes the doctor blade 24 during the course of the rotational motion of the screen-printing cylinder 12. When the indented screen section 31 passes in front of the doctor blade 24, the doctor blade 24 is pushed back counter to the force of the spring device toward the axis of the screen-printing cylinder 12. In order to prevent the doctor blade 24 from deforming the screen 23 in the screen section 31, the screen 23 is supported by an externally situated support element 36. The support element 36, as seen in FIG. 5 has the shape of a basin or of a trough that is uniformly curved in cross section, and is, for example, made of sheet metal or a rigid plastic, and is anchored at its two axial ends to the ends of the screen-printing cylinder 12. Preferably, the leading and trailing ends of the screen 23 are also disposed in the screen section 31 and are covered by the support element 36. The support element 36 can be adjusted in the radial direction, as indicated by arrow 37 in order to set the tension of the screen 23.

During the rotation of the cylinders 9 and 12 of the printing unit, since the support element 36 respectively coincides with the sheet gripper holding mechanism 29 of the rubber blanket cylinder 9 and consequently no ink can be accepted from the screen-printing cylinder 12 in the vicinity of the screen section 31, it is useful for the support element 36 to be embodied as a closed plate, which does not permit any ink to pass through the screen section 31 and reach the exterior of the screen-printing cylinder 12.

Figure 6:
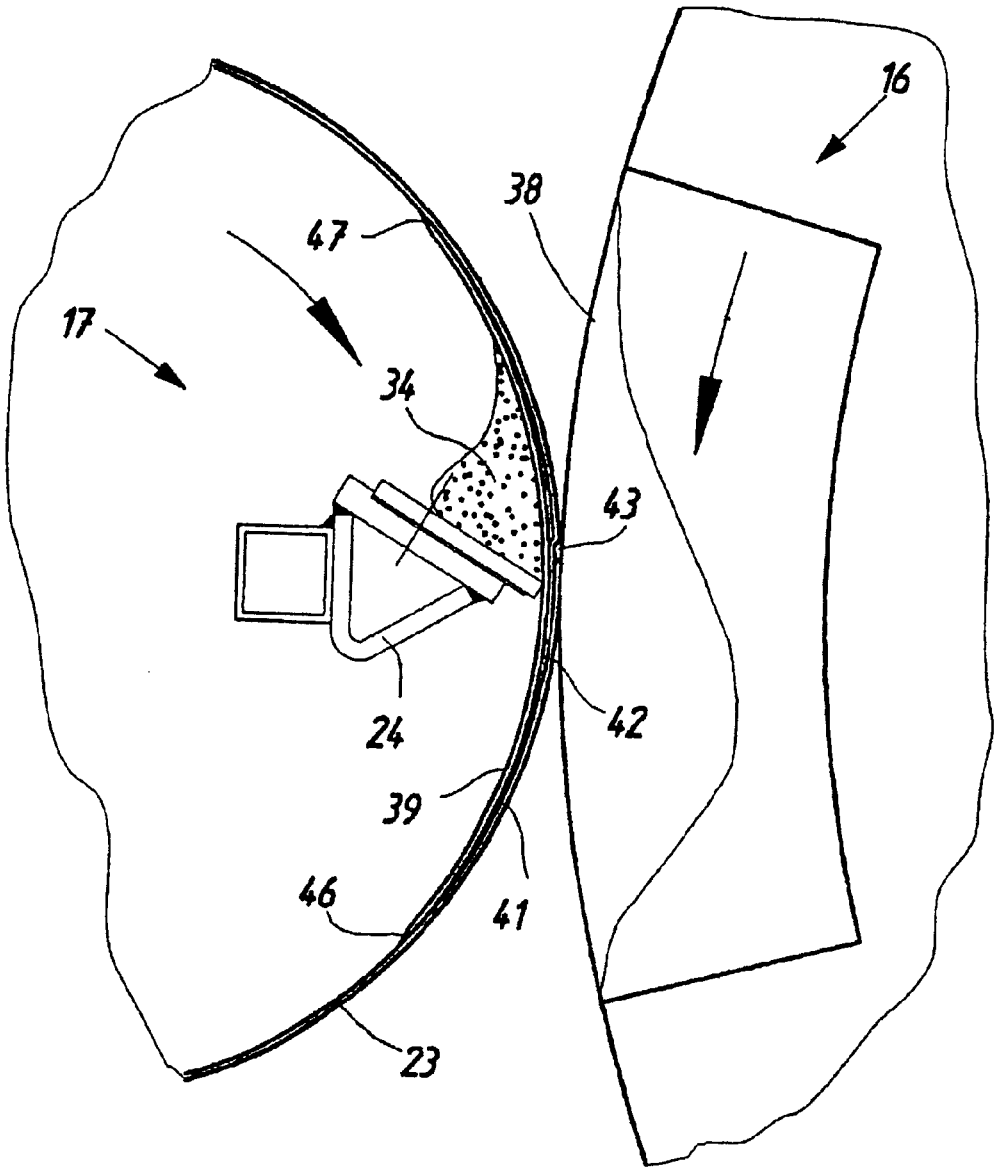
FIG. 6 is a side elevation view of a portion of a screen-printing cylinder and a transfer cylinder according to another preferred embodiment of a printing unit in accordance with the present invention.

FIG. 6 is a detailed depiction of another preferred embodiment of a screen-printing cylinder 17.

The screen-printing cylinder 17 depicted in FIG. 6 is cylindrical over its entire circumference, and is without an indented section. It is therefore suitable for cooperating with a second cylinder, which has no radially outward-protruding elements such as sheet gripping mechanisms for a print stock. With reference to the printing unit shown in FIG. 1, the second screen-printing cylinder 17 can have the configuration shown in FIG. 6. Hence in the description that follows, the screen-printing cylinder is identified at 17 and the cylinder that cooperates with it is identified at 16.

As was the case of the screen-printing cylinder depicted in FIGS. 4*a*, 4*b*, and 5, a doctor blade 24 is disposed on the inside of the screen-printing cylinder 17 shown in FIG. 6, and pushes a paste-like ink 34 through the screen 23 stretched on the screen-printing cylinder 17. Doctor blade 24 exerts a radially outward pressure on the screen 23. In the cooperating rotation of the screen-printing cylinder 17 and the rubber blanket cylinder 16, as long as the screen 23 of the screen-printing cylinder 17 touches the surface of the rubber blanket cylinder 16, this cylinder 16 supplies a counter-pressure, which prevents the doctor blade 24 from deforming the screen 23. In order to prevent such a deformation of the screen 23, even in the vicinity of the channel 38 of the cylinder 16, in which the screen 23 is not in contact with the rubber blanket cylinder 16, a support element 39 is disposed radially inside the screen 23. The support element 39 extends in the circumference direction of the screen-printing cylinder 17 over a section 41 of the screen 23, which corresponds to the span of the channel 38 on the rubber blanket cylinder 16. The support element 39 is configured as a closed plate made of metal or rigid plastic, which is curved in the form of a cylinder segment.

In this configuration depicted in FIG. 6, the support element 39 is attached radially inside the screen 23 and the leading end 42 and trailing end 43 of the screen 23 overlap each other in the section 41 of the screen 23 which is supported by the support element 39. Thus, the sensitive connection between the two ends 42 and 43 of the screen 23, which can be welded for example, is protected from contact with the doctor blade 24 and is therefore protected from premature wear.

A spring element for moving the doctor blade 24 in the radial direction could also be provided in this embodiment of a screen-printing cylinder 17 depicted in FIG. 6. However, since in this embodiment, the inner radius of the surface of the screen 23 that the doctor blade 24 sweeps across, is uniform or continuous, the configuration of the screen-printing cylinder 17 can be further simplified by eliminating the adjustability of the doctor blade 24 so that the fluctuations in the radius are compensated for solely through an elastic deformation of an elastic lip 44 of the doctor blade 24 touching the screen 23.

In a configuration of this kind, in order to facilitate the transition of the doctor blade 24 from the screen 23, onto the support element 39, and back onto the screen 23 again, and in order to avoid synchronization errors of the screen-printing cylinder 17, the support element 39 is provided with a leading edge 46 and a trailing edge 47, which are beveled in the circumference direction of the screen-printing cylinder 17. In addition, the present invention provides that these edges 46 and 47 do not extend exactly parallel to a generatrix of the outer surface of the screen-printing cylinder 17 or to the lip 44 of the doctor blade 24, but extend at a slight angle to them. For example, a sawtoothed, rafter-shaped, or sinusoidal curve of the edges 46 and 47 is conceivable. Preferably, the edges 46 and 47 each are configured as a helix with a pitch that is a multiple of the axial length of the screen-printing cylinder 17. When the doctor blade 24 is running onto or off these support element edges, such a curvature of the edges 46 and 47 prevents braking or acceleration forces acting on the screen-printing cylinder 17 from being exerted only at a certain point in time and at a particular angular position of the screen-printing cylinder 17. Instead, these forces are distributed over a circumferential section of the screen-printing cylinder 17 which, depending on the dimensions of the screen-printing cylinder 17, can be from several millimeters up to a few centimeters wide. This force distribution smoothes the torque required to drive the screen-printing cylinder 17 and prevents synchronization errors.

While preferred embodiments of a printing unit in accordance with the present invention have been set forth fully and completely hereinabove, it will be apparent to one of skill in the art that various changes in, for example the specific drives for the various cylinders, the specific sheet gripping mechanisms and the like can be made without departing from the true spirit and scope of the present invention which is accordingly to be limited only by the following claims.

What is claimed is:

1. A printing unit comprising:

a first screen-printing cylinder;

a first transfer cylinder cooperating with said first screen-printing cylinder;

a second screen-printing cylinder; and a second transfer cylinder cooperating with said second screen-printing cylinder, said first and second transfer cylinders forming a printing nip adapted to print materials passing through said printing nip.

2. The printing unit of claim 1 further including a sheet gripper mechanism on at least one of said first and second transfer cylinders.

3. The printing unit of claim 1 wherein each of said screen-printing cylinders includes a screen surface and further including means for preventing deformation of said screen surface of at least one of said screen-printing cylinders at a section of said screen surface.

4. The printing unit of claim 3 wherein each of said screen-printing cylinders includes an interiorly positioned doctor blade and further wherein said screen section deformation preventing means includes a guide slot in said screen-printing cylinder, said guide slot effecting radially inward movement of said doctor blade when said screen surface section is aligned with said doctor blade.

5. The printing unit of claim 1 wherein said first screen-printing cylinder is a first removable module and further wherein said second screen-printing cylinder is a second removable module, said first and second removable modules providing a modular configuration of the printing unit.

* * * * *